US006394758B1

(12) United States Patent
Lee et al.

(10) Patent No.: US 6,394,758 B1
(45) Date of Patent: May 28, 2002

(54) APPARATUS AND METHOD OF CONTROLLING AIR COMPRESSOR

(75) Inventors: Jae Young Lee, Nesville 301, 728-10, Yeok-Sam-Dong, Kang-Nam-Gu, Seoul; Yu Sang Han, Gyeonggi-Do, both of (KR)

(73) Assignee: Jae Young Lee, Seoul (KR)

( * ) Notice: Subject to any disclaimer, the term of this patent is extended or adjusted under 35 U.S.C. 154(b) by 30 days.

(21) Appl. No.: 09/710,843

(22) Filed: Nov. 14, 2000

(51) Int. Cl.[7] ..... F04B 49/10; F04B 49/00
(52) U.S. Cl. ..... 417/13; 417/32; 417/18
(58) Field of Search ..... 417/13, 32, 18; 290/40, 52; 318/801

(56) References Cited

U.S. PATENT DOCUMENTS

| | | | | | |
|---|---|---|---|---|---|
| 4,227,862 | A | * | 10/1980 | Andrew et al. | 417/12 |
| 4,505,186 | A | * | 3/1985 | Meier et al. | 277/317 |
| 5,635,768 | A | * | 6/1997 | Birch et al. | 290/40 C |
| 5,646,499 | A | * | 7/1997 | Doyama et al. | 318/801 |
| 6,093,975 | A | * | 7/2000 | Peticolas | 290/40 A |
| 6,236,183 | B1 | * | 5/2001 | Schroeder | 318/439 |
| 6,281,595 | B1 | * | 8/2001 | Sinha et al. | 290/40 A |

* cited by examiner

*Primary Examiner*—Teresa Walberg
*Assistant Examiner*—Daniel Robinson
(74) *Attorney, Agent, or Firm*—Rothwell, Figg, Ernst & Manbeck

(57) ABSTRACT

An apparatus and method of controlling air compressors is disclosed. In this invention, an air compressor is started to supply compressed air to an air tank. A temperature sensor senses the lubrication oil temperature of the compressor, and outputs a temperature signal to the controller, which compares the sensed oil temperature with a preset reference temperature. When the sensed oil temperature is not higher than the preset reference temperature, a pressure sensor senses the compressed air pressure within the tank, and outputs a pressure signal to the controller. When the compressed air pressure is higher than a minimum pressure, the controller lowers the frequency of a drive signal for the air compressor and operates the air compressor at a low rpm. When the compressed air pressure is higher than a preset maximum pressure, the controller operates the air compressor at a minimum rpm and partially discharges compressed air from the tank into the atmosphere. When the compressed air pressure is higher than a preset stop pressure, the controller stops the operation of the air compressor. When the compressed air pressure is not higher than the minimum pressure, the controller raises the frequency of the drive signal for the compressor, thus smoothly operating the air compressor and lengthening the expected life span of the air compressor.

5 Claims, 2 Drawing Sheets

APPARATUS AND METHOD OF CONTROLLING AIR COMPRESSOR

BACKGROUND OF THE INVENTION

1. Field of the Invention

The present invention relates to an apparatus and method of controlling an air compressor and, more particularly, to an apparatus and method of smoothly and effectively controlling the operation of such an air compressor while maintaining a desired target pressure of resulting compressed air and conserving electric power required for the operation of the compressor.

2. Description of the Prior Art

As well known to those skilled in the art, conventional air compressors have been typically controlled through a loading/offloading process or a suction air controlling process to maintain a desired target pressure of resulting compressed air. In such a conventional loading/offloading process, a predetermined load is applied to an air compressor, thus allowing the compressor to perform a desired compressing operation, the load being, thereafter, removed from the compressor when necessary, thus allowing the compressor to stop its compressing operation. It is thus possible for the compressor to maintain the desired target pressure of resulting compressed air. On the other hand, in the suction air controlling process, the desired target pressure of resulting compressed air is maintained by controlling the amount of suction air so as to finally control the amount of the resulting compressed air.

However, the conventional loading/offloading process is problematic in that the desired target pressure of resulting compressed air is accomplished by discharging surplus compressed air into the atmosphere, thus regrettably consuming excessive electric power to generate such surplus compressed air. On the other hand, the suction air controlling process is problematic in that it reduces the operational efficiency of an air compressor in addition to regrettably consuming excessive electric power while maintaining the target pressure of resulting compressed air.

SUMMARY OF THE INVENTION

Accordingly, the present invention has been made keeping in mind the above problems occurring in the prior art, and an object of the present invention is to provide an apparatus and method of controlling air compressors, which smoothly and effectively controls the operation of an air compressor.

Another object of the present invention is to provide an apparatus and method of controlling air compressors, which controls the operation of an air compressor while maintaining a desired target pressure of resulting compressed air.

A further object of the present invention is to provide an apparatus and method of controlling air compressors, which controls the operation of an air compressor while conserving electric power.

In its embodiment, the present invention provides an apparatus for controlling an air compressor, comprising: a controller for controlling the operation of the apparatus; an inverter circuit interfaced between the controller and the air compressor and used for modulating the frequency of a drive signal for the air compressor in response to a control signal output from the controller, and outputting the modulated drive signal to the air compressor so as to control the operation of the air compressor and to control the rpm of the air compressor; a temperature sensor connected to the controller and used for sensing the temperature of lubrication oil of the compressor and outputting a temperature signal to the controller; a main air tank connected to the air compressor through an air pipeline and used for storing compressed air supplied from the air compressor; and a pressure sensor connected to the controller and used for sensing the pressure of compressed air stored within the air tank and outputting a pressure signal to the controller.

The present invention also provides a method of controlling an air compressor, comprising the steps of: (a) starting the operation of the air compressor, thus allowing the compressor to supply compressed air to a main air tank through an air pipeline; (b) sensing the temperature of the lubrication oil in the air compressor using a temperature sensor; (c) determining whether the sensed lubrication oil temperature is higher than a preset reference temperature stored in the memory of the controlling mechanism; (d) primarily sensing the pressure of the compressed air within the air tank when the sensed lubrication oil temperature is not higher than the preset reference temperature; (e) determining whether the primarily sensed pressure of the compressed air within the air tank is higher than a preset minimum pressure stored in the memory; (f) lowering the frequency of a drive signal for the air compressor and outputting the regulated drive signal to the air compressor so as to operate the air compressor at a low rpm when the primarily sensed pressure of the compressed air is higher than the preset minimum pressure; (g) secondarily sensing the pressure of compressed air within the air tank using the pressure sensor; (h) determining whether the secondarily sensed pressure of the compressed air within the air tank is higher than a preset maximum pressure stored in the memory; (i) operating the air compressor at a minimum rpm and discharging the compressed air from the air tank into the atmosphere when the secondarily sensed pressure of the compressed air within the air tank is higher than the preset maximum pressure; (j) thirdly sensing the pressure of compressed air within the air tank using the pressure sensor; (k) determining whether the thirdly sensed pressure of the compressed air within the air tank is higher than a preset stop pressure stored in the memory; and (l) stopping the operation of the air compressor when the thirdly sensed pressure of the compressed air within the air tank is higher than the preset stop pressure.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
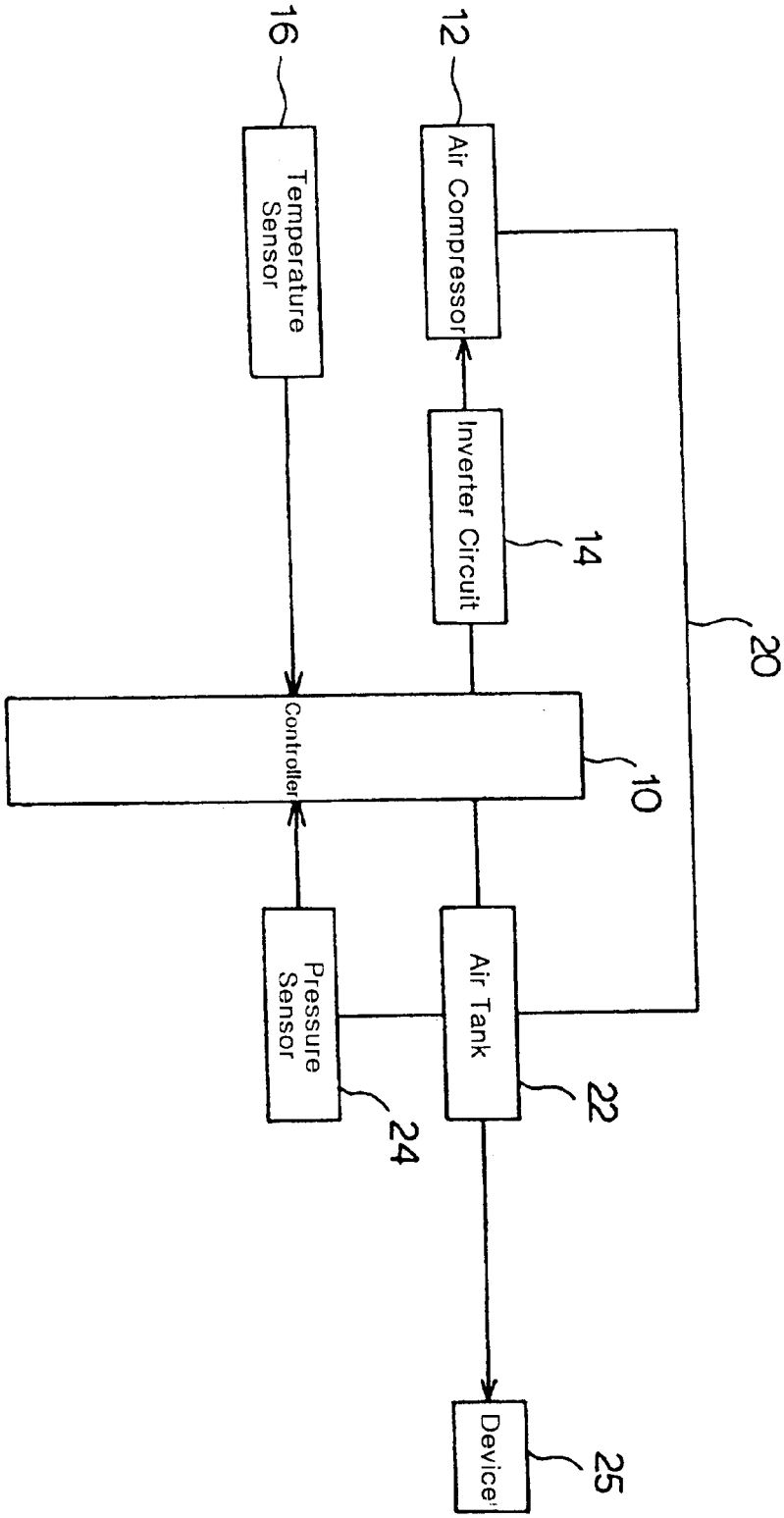
FIG. 1 is a block diagram, showing the construction of a control apparatus for air compressors in accordance with the preferred embodiment of the present invention.

FIG. 1 is a block diagram, showing the construction of a control apparatus for air compressors in accordance with the preferred embodiment of the present invention.

As shown in the drawing, the apparatus for controlling an air compressor 12 according to the preferred embodiment of the present invention comprises a controller 10 used for controlling the operation of the apparatus. An inverter circuit 14 is interfaced between the controller 10 and the air compressor 12. This inverter circuit 14 modulates the frequency of a drive signal for the air compressor 12 in response to a control signal output from the controller 10, and outputs the modulated drive signal to the air compressor 12 so as to control the operation of the air compressor 12. The air compressor 12 is thus operated at a controlled rpm. A temperature sensor 16 is connected to an input terminal of the controller 10, and senses the temperature of lubrication oil of the compressor 12 prior to outputting a temperature signal to the controller 10. The control apparatus of this invention also has a main air tank 22. The main air tank 22 is connected to the air compressor 12 through an air pipeline 20, and stores compressed air supplied from the air compressor 12. A pressure sensor 24 is connected to another input terminal of the controller 10, and senses the pressure of compressed air stored within the air tank 22 prior to outputting a pressure signal to the controller 10.

The operational effect of the above-mentioned control apparatus will be described herein below with reference to FIG. 2.

Figure 2:
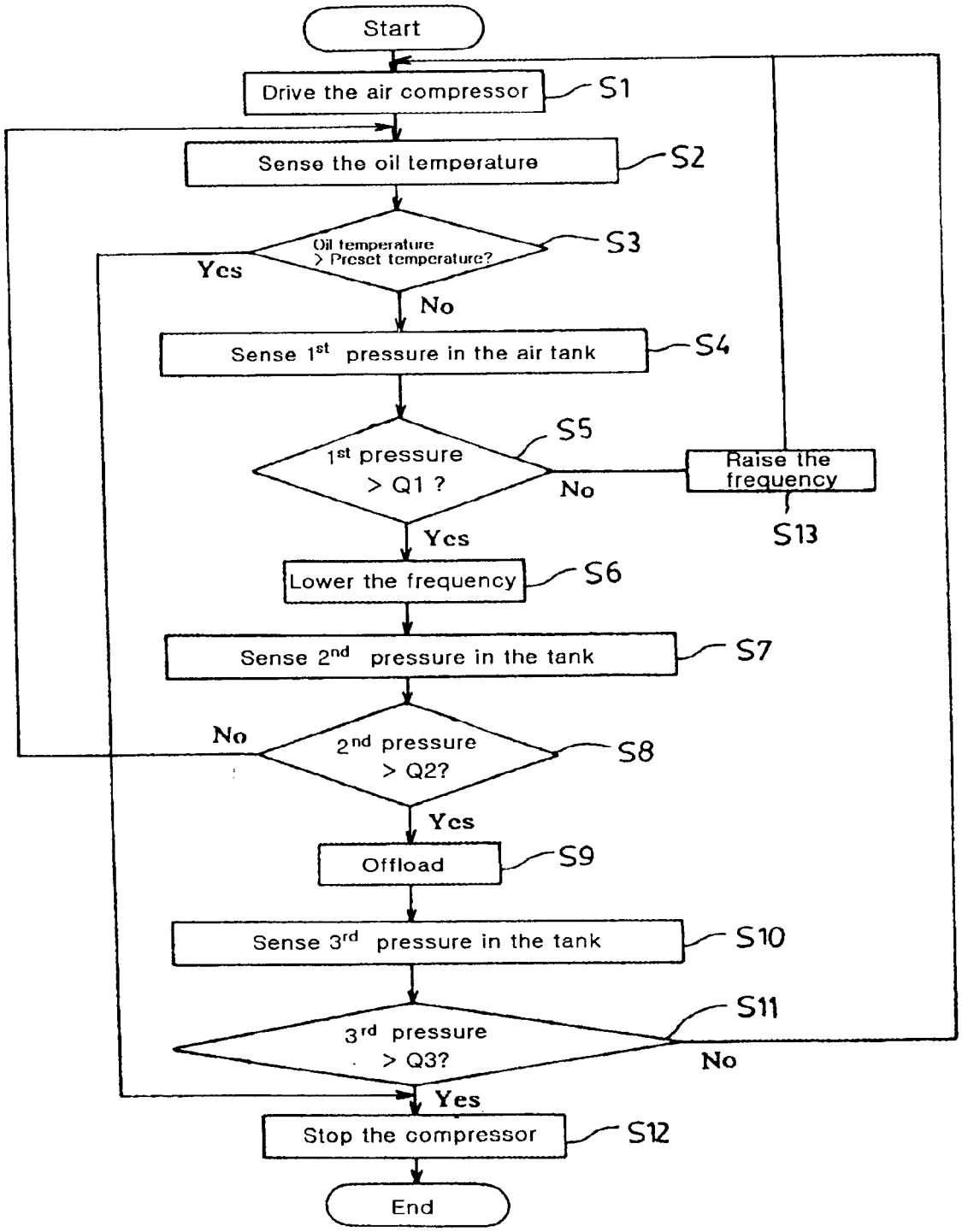
FIG. 2 is a flowchart, showing the process of controlling an air compressor in accordance with the preferred embodiment of the present invention.

FIG. 2 is a flowchart, showing the process of controlling the air compressor 12 in accordance with the preferred embodiment of the present invention. In the drawing, the reference character "S" denotes a Step of the control process of this invention, and so, for example, "S1" denotes "Step 1" of the control process.

In order to start the air compressor 12 under the control of the controller 10, the power button of a control panel (not shown) is primarily manipulated by an operator to input a start signal to the controller 10. The air compressor 12 thus starts its air compressing operation at step S1, and so the compressor 12 compresses air, and supplies compressed air to the main air tank 22 through the air pipeline 20. At step S2, the temperature sensor 16 senses the temperature of lubrication oil of the air compressor 12, and outputs a temperature signal to the controller 10.

Upon reception of the temperature signal output from the temperature sensor 16, the controller 10 compares the sensed temperature of the lubrication oil with a preset reference temperature stored in its memory so as to determine whether the sensed oil temperature is higher than the reference temperature at step S3. When the answer at step S3 is No, this means that the sensed oil temperature is not higher than the reference temperature. In such a case, the pressure sensor 24 primarily senses the pressure of the compressed air stored within the air tank 22, and outputs a primary pressure signal to the controller 10 at step S4.

Upon reception of the primary pressure signal output from the pressure sensor 24, the controller 10 compares the primarily sensed pressure of the compressed air with a preset minimum pressure Q1 stored in its memory so as to determine whether the sensed pressure is higher than the preset minimum pressure Q1 at step S5. When the answer at step S5 is Yes, this means that the primarily sensed pressure of the compressed air within the air tank 22 is higher than the preset minimum pressure Q1. In such a case, the inverter circuit 14 lowers the frequency of a drive signal for the air compressor 12 in response to a control signal output from the controller 10 at step S6, and outputs the regulated drive signal to the air compressor 12 so as to cause the air compressor 12 to operate at a low rpm and to supply compressed air to the air tank 22. At step S7, the pressure sensor 24 secondarily senses the pressure of the compressed air stored within the air tank 22, and outputs a secondary pressure signal to the controller 10. Upon reception of the secondary pressure signal output from the pressure sensor 24, the controller 10 compares the secondarily sensed pressure of the compressed air with a preset maximum pressure Q2 stored in its memory so as to determine whether the secondarily sensed pressure is higher than the preset maximum pressure Q2 at step S8. When the answer at step S8 is Yes, this means that the secondarily sensed pressure of the compressed air within the air tank 22 is higher than the preset maximum pressure Q2. This also means that the air compressor 12 is operated at the minimum rpm of about 500 rpm. Therefore, the controller 10 outputs an offloading signal to the air tank 22, thus allowing the tank 22 to partially discharge the compressed air into the atmosphere and regulating the pressure of the compressed air within the tank 22. Therefore, it is possible to prevent the pressure of the compressed air within the air tank 22 from exceeding the preset maximum pressure Q2.

At step S10, the pressure sensor 24 thirdly senses the pressure of compressed air within the air tank 22, and outputs a third pressure signal to the controller 10. Upon reception of the third pressure signal output from the pressure sensor 24, the controller 10 compares the thirdly sensed pressure of the compressed air with a preset stop pressure Q3 stored in its memory so as to determine whether the thirdly sensed pressure is higher than the stop pressure Q3 at step S11. In such a case, the preset stop pressure Q3 is a reference pressure, at which it is necessary to stop the operation of the air compressor 12.

When the answer at step S11 is Yes, this means that the thirdly sensed pressure of the compressed air within the air tank 22 is higher than the preset stop pressure Q3. In such a case, the controller 10 stops an output of the control signal to the air compressor 12 at step S12, thus stopping the operation of the compressor 12.

On the other hand, when the controller 10 determines that the sensed temperature of lubrication oil of the air compressor 12 is higher than the preset reference temperature at step S3, the controller 10 performs the step S12 to stop the operation of the air compressor 12. In addition, when the controller 10 determines that the primarily sensed pressure of compressed air within the air tank 22 is not higher than the preset minimum pressure Q1 at step S5, the controller 10 performs step S13. At the step S13, the controller 10 outputs a control signal to the inverter circuit 14 so as to allow the circuit 14 to raise the frequency of the drive signal for the air compressor 12 in response to the control signal. Thereafter, the controller 10 returns to the step S1 to repeat the above-mentioned process. On the other hand, when the controller 10 determines that the thirdly sensed pressure of the compressed air within the air tank 22 is not higher than the preset stop pressure Q3 at the step S11, the controller 10 returns to the step S1 to repeat the above-mentioned process.

The compressed air stored within the air tank 22 is supplied to a target device 25 when necessary so as to allow the device 25 to use the compressed air.

As described above, the present invention provides an apparatus and method of controlling air compressors. The control apparatus and method controls an air compressor in such a way that it primarily starts the air compressor so as to allow the compressor to supply compressed air to an air tank through an air pipeline. In such a case, a temperature sensor senses the temperature of lubrication oil of the air compressor, and outputs a temperature signal to the controller. Upon reception of the temperature signal, the controller compares the sensed oil temperature with a preset reference temperature. When the controller determines that the sensed oil temperature is not higher than the preset reference temperature, a pressure sensor primarily senses the pressure of compressed air within the air tank, and outputs a primary pressure signal to the controller. The controller then compares the primarily sensed pressure with a preset minimum pressure Q1. When the primarily sensed pressure of the compressed air is higher than the preset minimum pressure Q1, the controller lowers the frequency of a drive signal for the air compressor, and optimally controls the operation of the air compressor. On the other hand, when a secondarily sensed pressure of the compressed air within the air tank is higher than a preset maximum pressure Q2, the controller operates the air compressor at a minimum rpm in addition to partially discharging compressed air from the air tank into the atmosphere. When the controller determines that a thirdly sensed pressure of the compressed air within the air tank is higher than a preset stop pressure Q3, the controller stops the operation of the air compressor. On the other hand, when the primarily sensed pressure of the compressed air within the air tank is not higher than the minimum pressure Q1, the controller raises the frequency of the drive signal for the air compressor so as to control the operation of the air compressor. The control apparatus and method of the present invention thus effectively and smoothly controls the operation of an air compressor and maintains a desired pressure of compressed air generated by the air compressor. The control apparatus and method also reduces the consumption of electric power required for the operation of the air compressor. Another advantage of the apparatus and method according to the present invention resides in that it always smoothly operates the motor of the air compressor, thus allowing the motor to be free from undesired mechanical load and thereby lengthening the expected life span of the air compressor.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An apparatus for controlling an air compressor, comprising:

a controller for controlling an operation of said apparatus;

an inverter circuit interfaced between the controller and the air compressor and used for modulating a frequency of a drive signal for the air compressor in response to a control signal output from the controller, and outputting the modulated drive signal to the air compressor so as to control the operation of said air compressor and to control the rpm of the air compressor;

a temperature sensor connected to said controller and used for sensing a temperature of lubrication oil of the compressor and outputting a temperature signal to the controller;

a main air tank connected to the air compressor through an air pipeline and used for storing compressed air supplied from the air compressor; and a pressure sensor connected to the controller and used for sensing a pressure of compressed air stored within the air tank and outputting a pressure signal to the controller.

2. A method of controlling an air compressor, comprising the steps of:

(a) starting an operation of the air compressor, thus allowing the compressor to supply compressed air to a main air tank through an air pipeline;

(b) sensing a temperature of lubrication oil of the air compressor using a temperature sensor;

(c) determining whether the sensed lubrication oil temperature is higher than a preset reference temperature stored in a memory of a controller;

(d) primarily sensing a pressure of the compressed air within the air tank when the sensed lubrication oil temperature is not higher than the preset reference temperature;

(e) determining whether the primarily sensed pressure of the compressed air within the air tank is higher than a preset minimum pressure stored in the memory;

(f) lowering a frequency of a drive signal for the air compressor and outputting the regulated drive signal to the air compressor so as to operate the air compressor at a low rpm when the primarily sensed pressure of the compressed air is higher than the preset minimum pressure;

(g) secondarily sensing a pressure of compressed air within the air tank using said pressure sensor;

(h) determining whether the secondarily sensed pressure of the compressed air within the air tank is higher than a preset maximum pressure stored in the memory;

(i) operating the air compressor at a minimum rpm and discharging the compressed air from the air tank into the atmosphere when the secondarily sensed pressure of the compressed air within the air tank is higher than the preset maximum pressure;

(j) thirdly sensing a pressure of compressed air within the air tank using the pressure sensor;

(k) determining whether the thirdly sensed pressure of the compressed air within the air tank is higher than a preset stop pressure stored in the memory; and (l) stopping the operation of said air compressor when the thirdly sensed pressure of the compressed air within the air tank is higher than the preset stop pressure.

3. The method according to claim 2, wherein said controller performs the step (l) so as to stop the operation of the air compressor when the sensed lubrication oil temperature is higher than the preset reference temperature.

4. The method according to claim 2, wherein said controller outputs a control signal to an inverter circuit so as to allow the inverter circuit to raise the frequency of the drive signal for the air compressor in response to said control signal, and returns to the step (a) when the secondarily sensed pressure of the compressed air within the air tank is not higher than the preset maximum pressure.

5. The method according to claim 2, wherein the controller returns to the step (a) when the thirdly sensed pressure of the compressed air within the air tank is not higher than the preset stop pressure.

* * * * *